US007281372B2

(12) United States Patent
Sakai et al.

(10) Patent No.: US 7,281,372 B2
(45) Date of Patent: Oct. 16, 2007

(54) HYDRAULIC CONTROLLER AND HYDRAULIC DRIVE UNIT PROVIDED WITH SAID HYDRAULIC CONTROLLER

(75) Inventors: Yoshitake Sakai, Toki (JP); Osamu Sato, Minokamo (JP)

(73) Assignee: Kayaba Industry Co., Ltd., Tokyo (JP)

( * ) Notice: Subject to any disclaimer, the term of this patent is extended or adjusted under 35 U.S.C. 154(b) by 21 days.

(21) Appl. No.: 11/326,488

(22) Filed: Jan. 6, 2006

(65) Prior Publication Data

US 2006/0168956 A1 Aug. 3, 2006

(30) Foreign Application Priority Data

Jan. 19, 2005 (JP) ..... 2005-011186

(51) Int. Cl.
*F15B 11/00* (2006.01)
*F15B 1/00* (2006.01)

(52) U.S. Cl. ..... 60/434; 60/476

(58) Field of Classification Search ..... 60/384, 60/473, 476; 417/410.1; 92/141
See application file for complete search history.

(56) References Cited

U.S. PATENT DOCUMENTS 2,457,467 A * 12/1948 Hartman ..... 60/476
3,515,167 A * 6/1970 Svenson ..... 60/434
4,924,670 A * 5/1990 Bausch et al. ..... 60/418
5,104,294 A * 4/1992 Banba ..... 60/418
5,263,825 A * 11/1993 Doolin ..... 417/63
5,281,013 A * 1/1994 Pichon et al. ..... 417/471
6,519,939 B1 * 2/2003 Duff ..... 60/473
6,524,084 B2 * 2/2003 Neumair ..... 417/372
6,568,919 B1 * 5/2003 Fletcher et al. ..... 417/307
6,786,709 B1 * 9/2004 Klahm et al. ..... 418/39
7,055,317 B2 * 6/2006 Knapp et al. ..... 60/478
7,055,320 B2 * 6/2006 Nagai et al. ..... 60/476

FOREIGN PATENT DOCUMENTS

JP 09-058438 3/1997
JP 11-294345 10/1999

* cited by examiner

*Primary Examiner*—Thomas E. Lazo
(74) *Attorney, Agent, or Firm*—Hiroe & Associates; Michael L Crapenhoft

(57) ABSTRACT

A hydraulic controller in which driving sound and the number of parts can be reduced, and a long service life can be realized, and a hydraulic drive unit provided with said hydraulic controller. The hydraulic controller for a hydraulic drive unit includes a housing that includes an electric motor housing configured to house an electric motor, an oil pump housing configured to house a hydraulic pump, and a valve housing configured to house valves are integrated together.

15 Claims, 7 Drawing Sheets

FIG. 2(a)
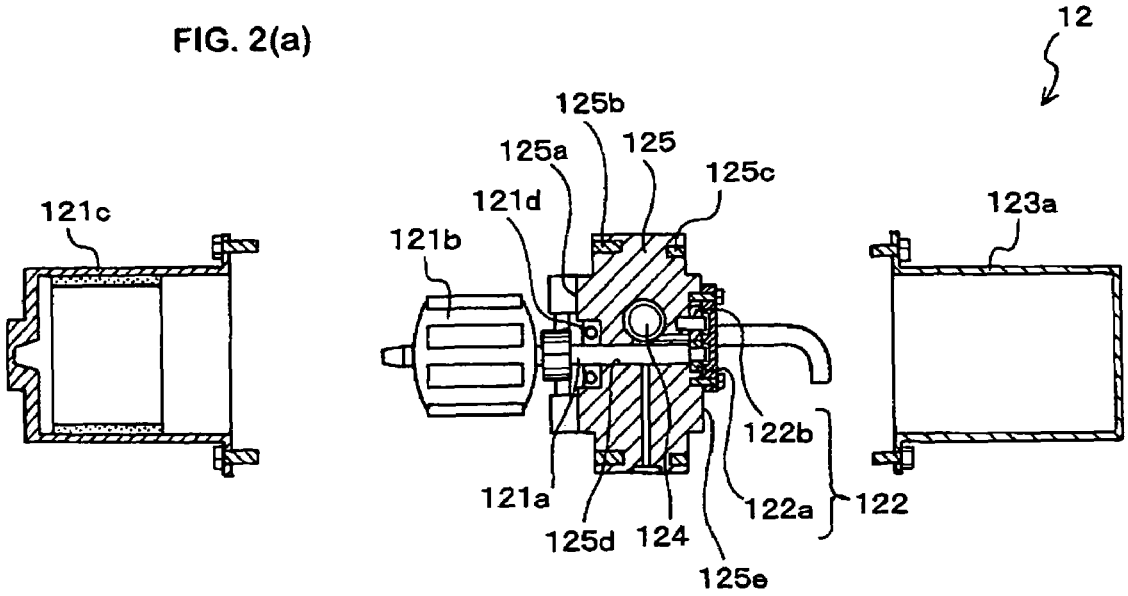
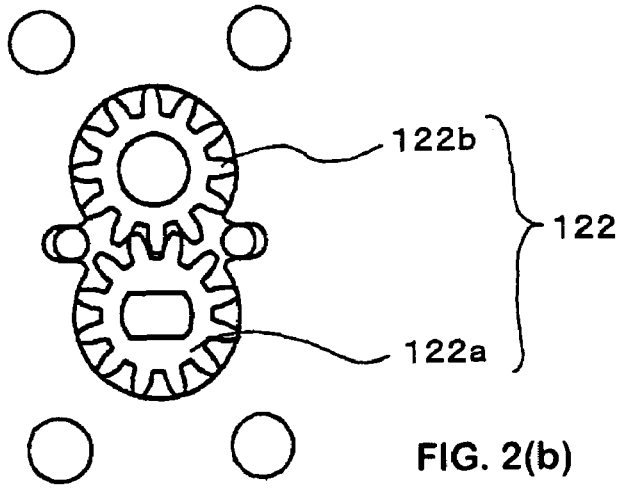
FIG. 2(b)

FIG. 5(a)
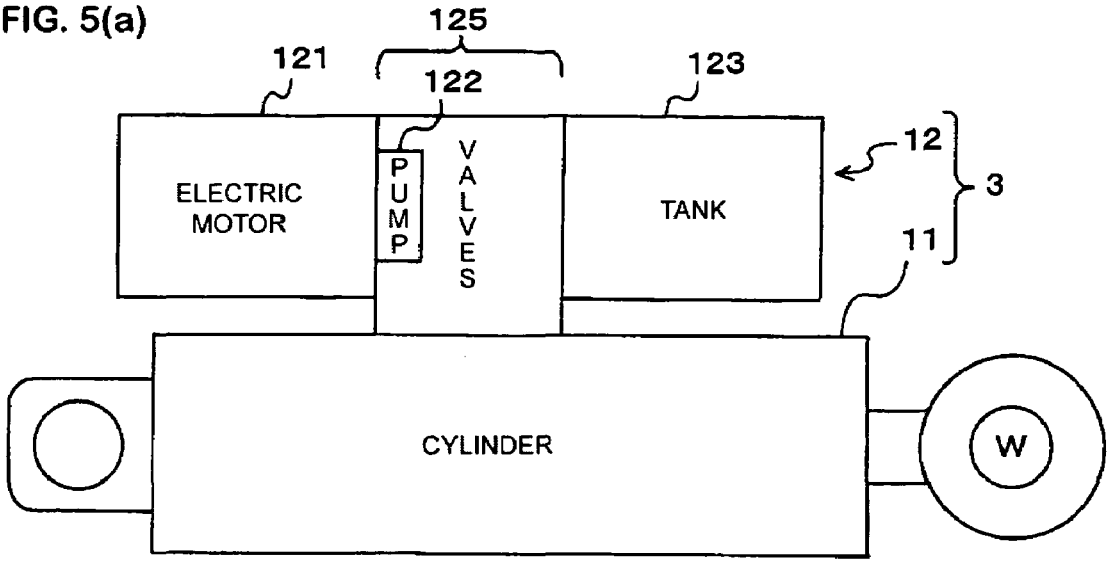
FIG. 5(b)
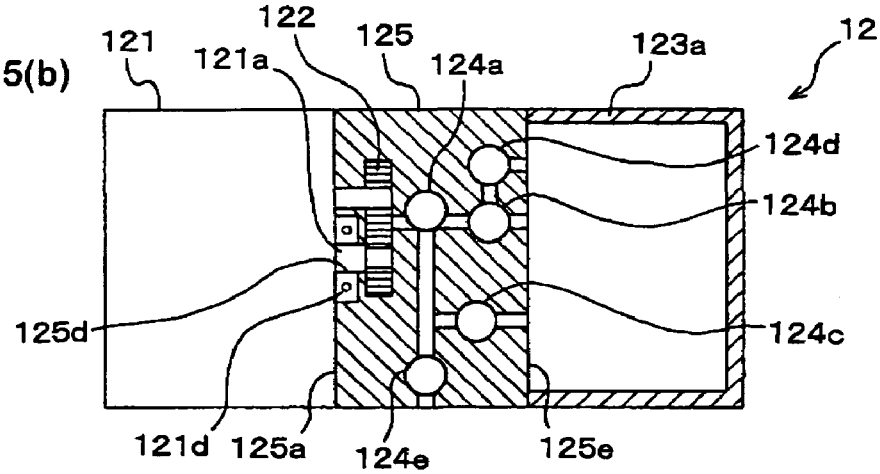
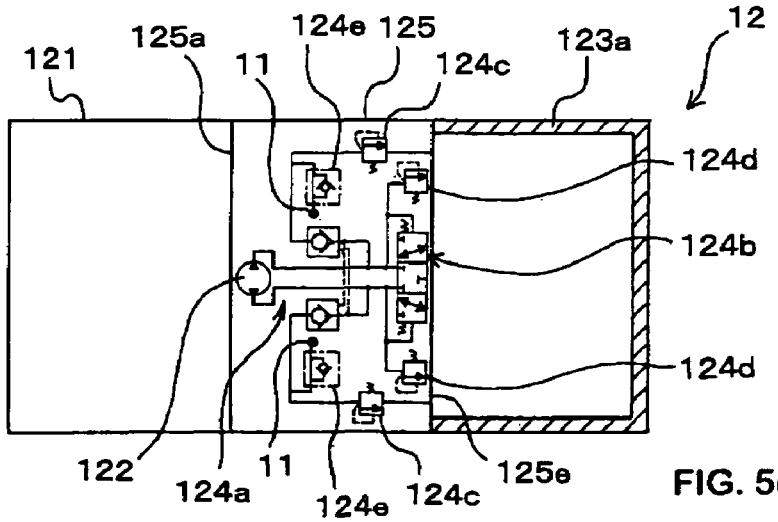
FIG. 5(c)

FIG. 7(a)
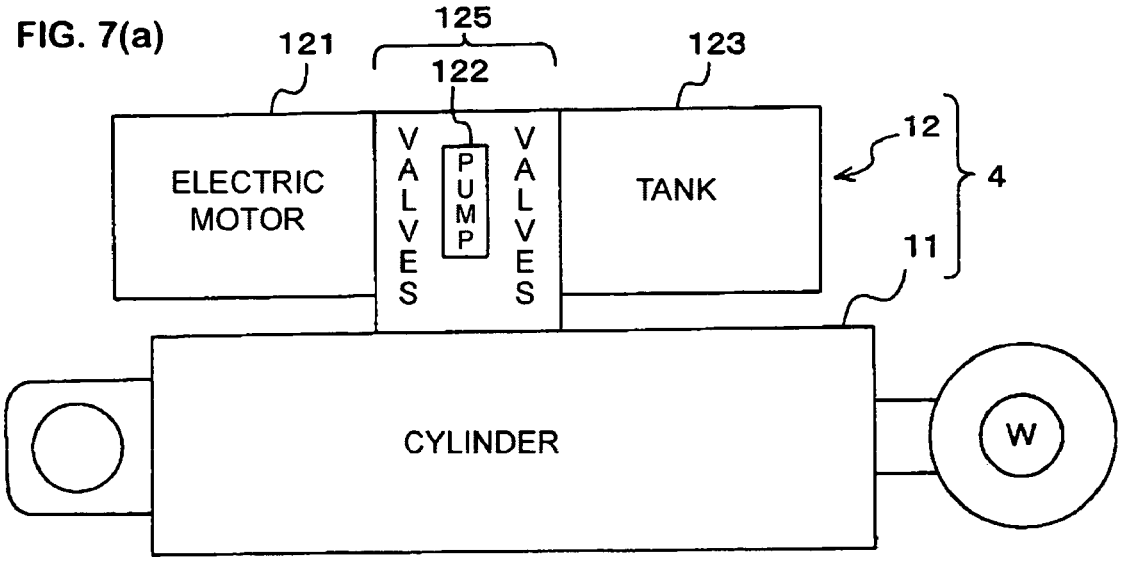
FIG. 7(b)
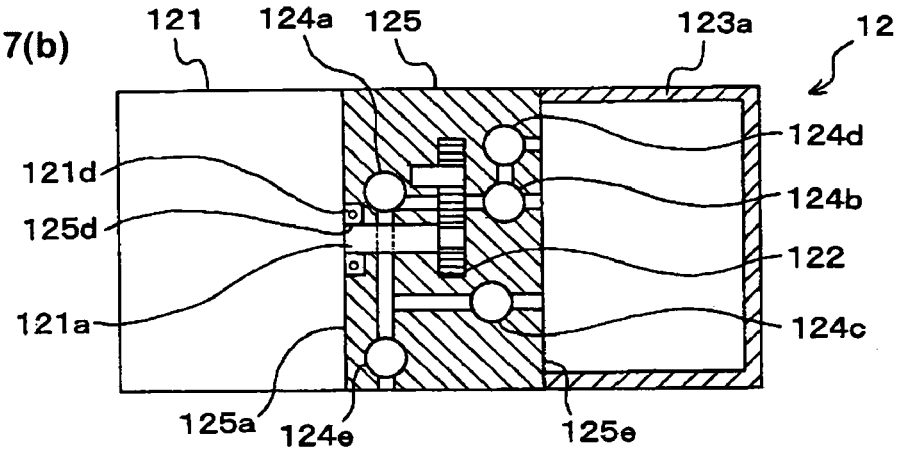
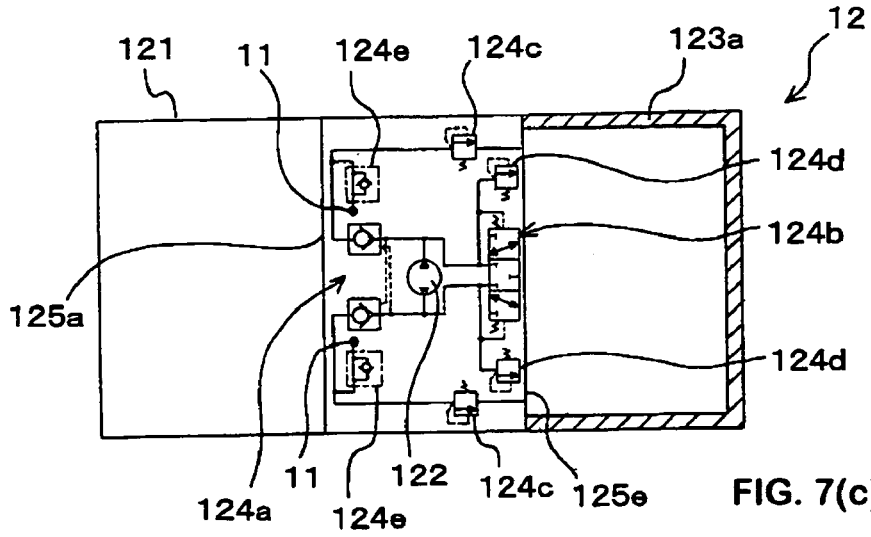
FIG. 7(c)

HYDRAULIC CONTROLLER AND HYDRAULIC DRIVE UNIT PROVIDED WITH SAID HYDRAULIC CONTROLLER

BACKGROUND OF THE INVENTION

The present invention relates to a hydraulic controller that includes a housing structure, and a hydraulic drive unit provided with the said hydraulic controller.

A hydraulic drive unit that easily provides a driving force created by an oil pressure without laying hydraulic pipes if only an electric power source is present has been used, for example, for lifting work equipment of a special agricultural vehicle with respect to the cultivated ground, and in the future, the expansion of industrial application to many fields is anticipated.

The hydraulic drive unit is broadly made up of an actuator (usually, a "hydraulic cylinder" is used) and a hydraulic controller for operating (expanding and contracting in the case of the hydraulic cylinder) the actuator. The hydraulic controller includes an electric motor capable of rotating in a normal and a reverse direction, a hydraulic pump for sending hydraulic oil under pressure in the normal and reverse directions by means of the rotation of the electric motor, an oil tank for storing hydraulic oil in an enclosed space, a valve for controlling the flow of hydraulic oil in the normal and reverse directions among the hydraulic pump, the oil tank, and the actuator, and a housing (also referred to as a body block), which contains the hydraulic pump, the valve, and the like, and which is formed with an oil path therein.

The housing as described, for example, in Unexamined Japanese Patent Publication No. 11-29345 is formed into a block shape, and in one of the bottom surface portions (one bottom surface portion) thereof is formed a motor connecting portion. When the electric motor is connected to the motor connecting portion, the output shaft of the electric motor is fitted in a hole (fitting hole) formed in the housing, with the output shaft being connected to the driving shaft of the hydraulic pump.

However, in the configuration in which the output shaft of the electric motor is fitted in the hole formed in the housing and also connected to the driving shaft of the hydraulic pump, both of the fitting portion in which the electric motor is connected to the housing and the fitting portion in which the hydraulic pump is connected to the housing must be fabricated with high accuracy. Otherwise, because the output shaft of the electric motor is connected to the driving shaft of hydraulic pump later, the rotation center cannot be aligned, which poses a problem in that noise is generated when the motor and pump are driven, and an improper force acts in the interior and hence the assembly's service life is reduced. Also, a problem is present in that it is difficult to reduce the number of parts of the hydraulic drive unit and thereby to reduce its cost. Also, in the case where an electric motor housing for disposing the electric motor, a hydraulic pump housing for installing the hydraulic pump, and valves are present, because of a configuration such that these elements are connected to each other after a valve housing containing the valves has been manufactured separately, there arises a problem in that the manufacturing cost is high, and the reduction in the number of parts is similarly hindered.

In this respect, Unexamined Japanese Patent Publication No. 9-58438 has disclosed a configuration in which the electric motor housing and the hydraulic pump housing are integrated. In this case, however, the valve housing containing the valves is not integrated unlike the hydraulic drive unit.

SUMMARY OF THE INVENTION

The present invention has been made in view of the above situation, and accordingly, preferred embodiments of the invention provide a hydraulic controller capable of reducing noise and the number of parts and realizing a long service life, and a hydraulic drive unit provided with the hydraulic controller.

A preferred embodiment provides a hydraulic controller for a hydraulic drive unit, in which the controller includes a housing that includes an electric motor housing configured to house an electric motor, an oil pump housing configured to house a hydraulic oil pump, and a valve housing configured to house valves, and in which the electric motor housing, the oil pump housing, and the valve housing are all integrated.

The invention is also embodied in a hydraulic drive unit that includes a hydraulic controller of the type described herein, in combination with an actuator that is driven by the hydraulic controller.

Preferred embodiments of hydraulic controllers and hydraulic drive units of the type described herein can reduce noise generated by the devices' operations, reduce the number of parts required for such assemblies, and achieve long operational service lives.

BRIEF DESCRIPTION OF THE DRAWINGS

The principles of the invention can be better understood by reference to the drawings included herewith, in which:

FIG. 2(*a*) is an exploded view of a hydraulic controller which is a component of the hydraulic drive unit depicted in FIG. 1;

FIG. 2(*b*) is a schematic plan view of a hydraulic pump portion shown in FIG. 2(*a*);

FIGS. 5(*a*)-5(*c*) schematically illustrate a third example of a hydraulic drive unit of the type illustrated in FIGS. 3 and 4, focusing especially on the arrangement of the unit's parts, in which:

FIG. 5(*a*) is a general arrangement view;

FIG. 5(*b*) is an arrangement view showing an internal configuration excluding the hydraulic cylinder portion shown in FIG. 5(*a*), viewed from the side; and FIG. 5(*c*) is an arrangement view expressed in terms of a hydraulic circuit, in which FIG. 5(*b*) is viewed from the top;

FIGS. 7(*a*)-7(*c*) schematically illustrate a fourth example of a hydraulic drive unit, focusing especially on the arrangement of its parts; in which:

FIG. 7(*a*) is a general arrangement view;

FIG. 7(*b*) is an arrangement view showing an internal configuration excluding a hydraulic cylinder portion shown in FIG. 7(*a*), viewed from the side; and FIG. 7(*c*) is an arrangement view expressed in terms of a hydraulic circuit, in which FIG. 7(*b*) is viewed from the top.

DETAILED DESCRIPTION OF THE PREFERRED EMBODIMENTS

Examples of preferred embodiments of the present invention will now be described with reference to the accompanying drawings. It should be noted that the examples described below merely show preferred embodiments of the present invention, and the technical scope of the present invention is not limited by the examples described below. For example, in the examples described below, the whole of a hydraulic drive unit is explained. However, a hydraulic controller that is a component of a hydraulic drive unit is also included in the technical scope of the present invention.

EXAMPLE 1

Figure 1:
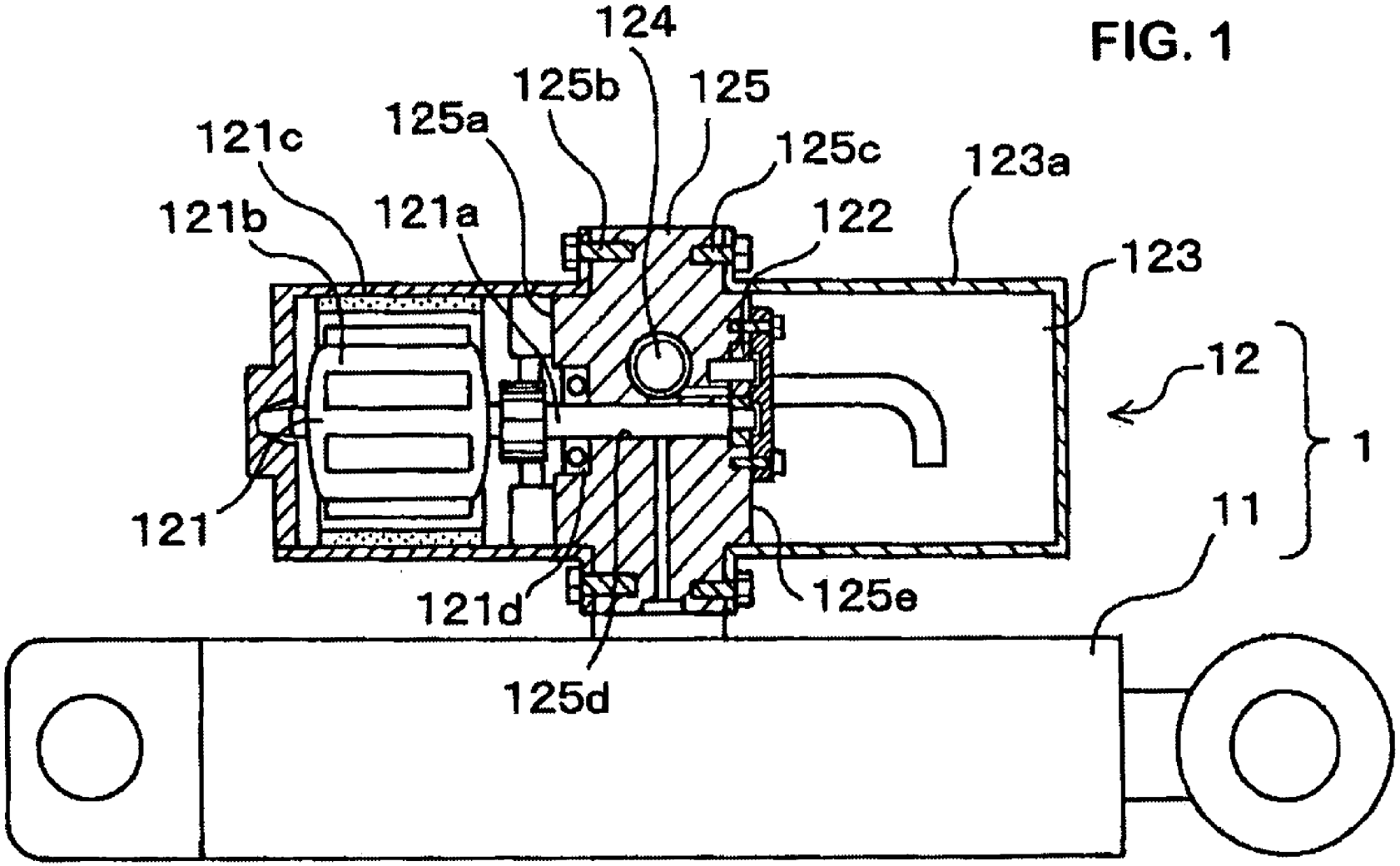
FIG. 1 is a schematic view (in partial section) of a hydraulic drive unit according to a first example of the present invention.

First, a hydraulic drive unit 1 of one example (Example 1) of the present invention is explained with reference to FIGS. 1, 2(*a*), and 2(*b*). FIG. 1 is a schematic view (in partial section) of the hydraulic drive unit of Example 1 of the present invention. FIG. 2(*a*) is an exploded view of a hydraulic controller which is a component of the hydraulic drive unit of Example 1, and FIG. 2(*b*) is a schematic plan view of a hydraulic pump portion shown in FIG. 2(*a*). The hydraulic drive unit 1 is made up of a hydraulic cylinder 11 that is one kind of an actuator, and a hydraulic controller 12 for expanding and contracting the hydraulic cylinder 11.

The hydraulic controller 12 includes an electric motor 121 capable of rotating in the normal and reverse directions, a hydraulic pump 122 for sending hydraulic oil under pressure in the normal and reverse directions by means of the rotation of the electric motor 121, an oil tank 123 for storing hydraulic oil in an enclosed space, valves 124 for controlling the flow of hydraulic oil in the normal and reverse directions between the oil tank 123 and the hydraulic cylinder 11, and a housing 125 (also referred to as a body block), which contains the hydraulic pump 122, the valves 124, and the like, and which is formed with an oil path therein.

The housing 125 is fitted with a bearing 121*d* in a portion in which a fitting hole 125*d* for an output shaft 121*a* of the electric motor 121 is formed, which portion is one of bottom surface portions 125*a* (referred to as "one bottom surface portion" in this specification) of the housing 125. The configuration is such that the output shaft 121*a* of the electric motor 121, which is fitted in the fitting hole 125*d*, is rotatably supported by the bearing 121*d*. The output shaft 121*a* is directly connected to hydraulic pump 122. Therefore, even if precise fabrication is not achieved, the rotation center of the output shaft 121*a* inserted in the insertion hole 121*d* can be aligned. Hence, noise generated by interference of the output shaft 121*a* with the housing 125 etc. can be reduced, with that excessive wear restrained and a long service life thereby obtained.

Also, in the housing 125, an armature 121*b*, which is a component of the electric motor 121, the output shaft 121*a*, the bearing 121*d*, and other electric motor components are assembled in advance, and a motor cover body attachment portion 125*b* configured to receive and hold a motor cover body 121*c*, which is a component of the electric motor 121, is formed. Further, in the housing 125, an oil tank cover body attachment portion 125*c* capable of detachably mounting an oil tank cover body 123*a*, which is a component of the oil tank 123, at a later stage is formed.

That is to say, the housing 125 is also used as a housing for the electric motor 121, the hydraulic pump 122, the oil tank 123, and the valves 124. In other words, the housing for the electric motor 121, the housing for the hydraulic pump 122, the housing for the oil tank 123, and the housing for the valves 124 are integrated. The number of required parts is thereby reduced, and a low cost and compactness can be achieved.

In Example 1, the hydraulic pump 122 is a gear pump, and, as also shown in FIG. 2(*b*), the hydraulic pump 122 has a drive gear 122*a* and a driven gear 122*b*, and the output shaft 121*a* is connected to the drive gear 122*a* directly and fitted in the other of the bottom surface portions 125*e* (referred to as "the other bottom surface portion" in this specification) of the housing 125. Since the hydraulic pump 122 is provided relatively near the hydraulic tank 123, the suction efficiency of hydraulic oil from the oil tank 123 is improved.

The "housing" for the electric motor 121 in the present invention means a housing that can incorporate at least some of the electric motor components, such as the armature 121*b*, the output shaft 121*a*, the bearing 121*d*, and a commutator (not shown), but at least the bearing 121*d*.

Similarly, the "housings" for the hydraulic pump 122, for the oil tank 123, and for the valves 124 also mean housings which can house some of the hydraulic pump components, the oil tank components, and the valve components, respectively.

EXAMPLE 2

Figure 3:
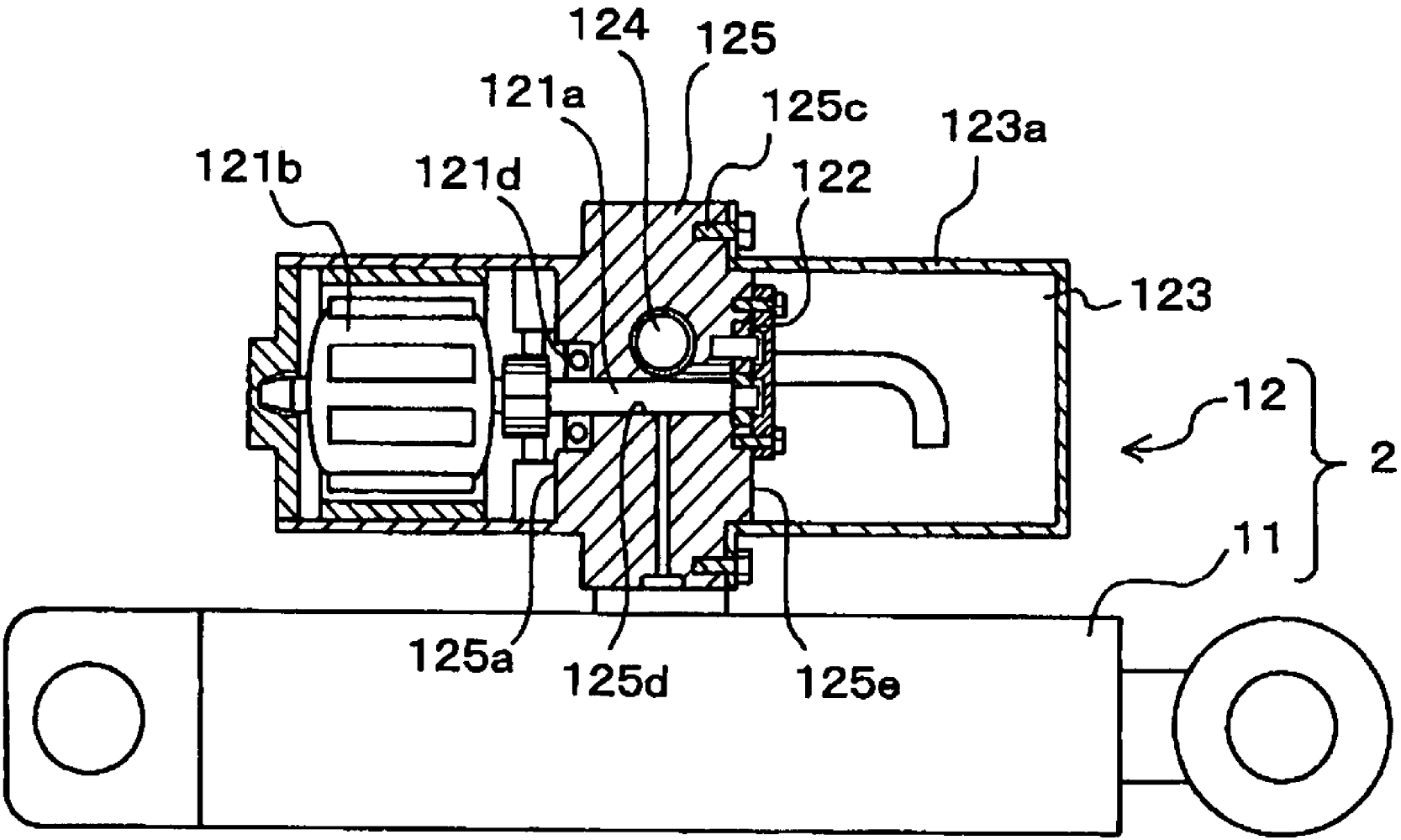
FIG. 3 is a schematic view of a hydraulic drive unit according to a second example of the invention.
Figure 4:
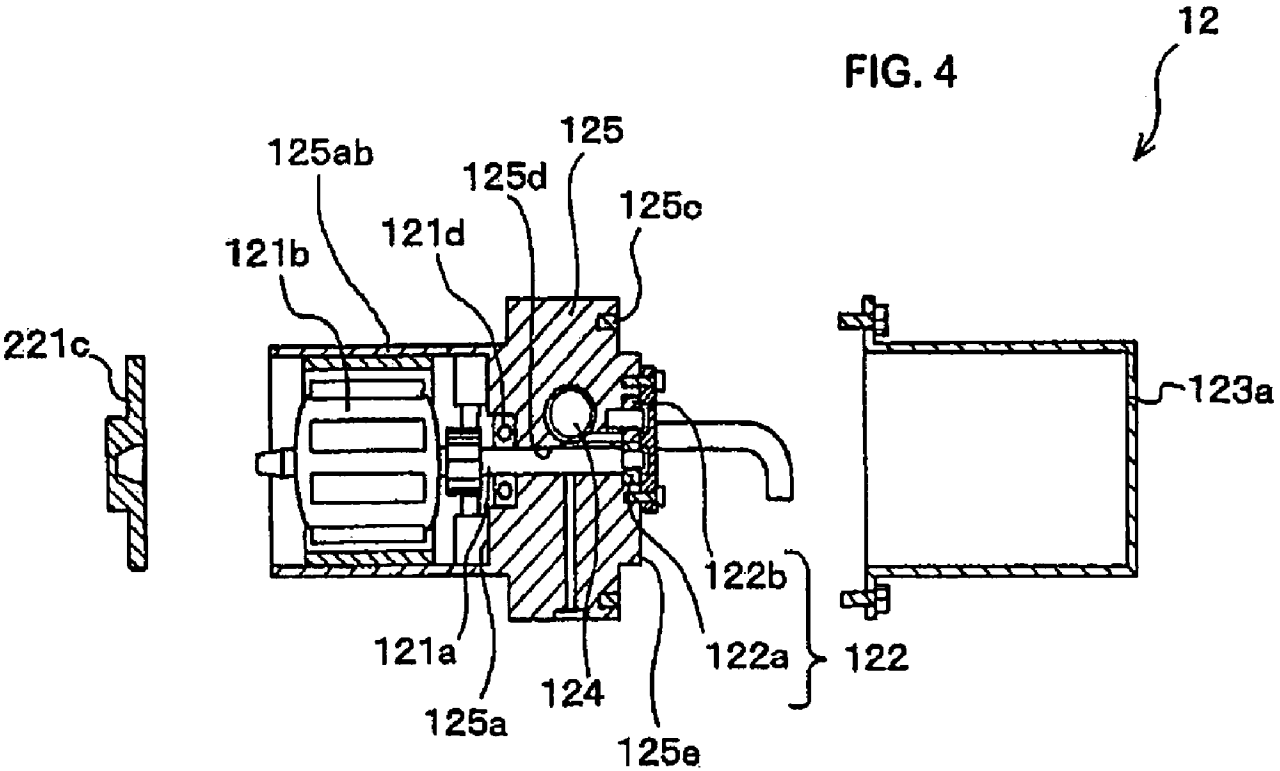
FIG. 4 is an exploded view of a hydraulic controller which is a component of the hydraulic drive shown in FIG. 3.

Next, another example (Example 2) is explained with reference to FIGS. 3 and 4. Hereunder, the same reference characters are applied to portions explained already, the explanation thereof being omitted, and only different portions are explained.

In a hydraulic drive unit 2 of Example 2, a part of the housing 125 forms an electric motor cover body 125*ab* onto which is fitted a cap body 221*c*. Not only can the manpower required for assembly thereby be reduced but it is also possible to avoid damaging or misassembling components of the electric motor 121, which has been assembled to the housing 125, during the assembly process.

EXAMPLE 3

Next, still another example (Example 3) is explained with reference to FIGS. 5(*a*), (*b*), and (*c*) and FIG. 6. In Example 3, the position of the hydraulic pump 122 disposed in the housing 125 is changed, and an arrangement of the valves 124 that accommodates the change of the position of the hydraulic pump 122 is shown clearly.

Before Example 3 is explained, the features of the basic configuration of the valves 124 are explained. FIG. 6 is a hydraulic circuit diagram showing a basic configuration of a hydraulic drive unit 3. The hydraulic circuit shown in FIG. 6 is the same as the hydraulic circuits used in the devices of Example 1 and Example 2.

The valves 124 include, as basic components, an operate check valve 124*a* for controlling the flow of hydraulic oil in the normal and reverse directions between the hydraulic pump 122 and the hydraulic cylinder 11, and a switching valve 124*b* for controlling the flow of hydraulic oil in the normal and reverse directions between the hydraulic pump 122 and the oil tank 123.

The operate check valve 124*a* basically includes a pair of check valves OCa that allow only the flow of hydraulic oil from the hydraulic pump 122 to the hydraulic cylinder 11, and a pair of pilot lines OCb for conveying hydraulic oil from one check valve OCa to the other check valve OCa.

The paired check valves OCa are provided in a pipe line connecting one port of the hydraulic pump 122 to a bottom-side oil chamber OAa of the hydraulic cylinder 11 and in a pipe line connecting the other port of the hydraulic pump 122 to a rod-side oil chamber OAb of the hydraulic cylinder 11.

The switching valve 124*b* performs switchover between either of the pipe lines between the hydraulic pump 122 and the bottom-side oil chamber OAa of the hydraulic cylinder 11 and between the hydraulic pump 122 and the rod-side oil chamber OAb of the hydraulic cylinder 11 and the oil tank 123.

In the explanation below, in some cases the left-hand side check valve OCa in FIG. 6 of the check valves OCa arranged in a pair at the left and right is called a bottom-side check valve OCa as a check valve relating to the hydraulic oil going into and out of the bottom-side oil chamber OAa of the hydraulic cylinder 11, and the right-hand side check valve OCa is called a rod-side check valve OCa as a check valve relating to the hydraulic oil going into and out of the rod-side oil chamber OAb. Similarly for the ports of the hydraulic pump 122, in some cases the left-hand side port is called a bottom-side port, and the right-hand side port is called a rod-side port.

In the above-described configuration, according to the hydraulic drive unit 3, in a state in which the hydraulic pump 122 is stopped, the outflow of hydraulic oil from both of the bottom-side oil chamber OAa and the rod-side oil chamber OAb of the hydraulic cylinder 11 is inhibited by the operate check valves 124*a*, so that the hydraulic cylinder 11 is kept in the present stationary state against an applied external force.

When the hydraulic pump 122 is operated so that the hydraulic oil is discharged to the bottom-side port, the hydraulic oil, passing through the bottom-side check valve OCa, is supplied from the hydraulic pump 122 to the bottom-side oil chamber OAa. At the same time, the rod-side check valve OCa is pushed and opened by the hydraulic oil pressure in the bottom-side pilot line OCb. Therefore, the outflow of hydraulic oil from the rod-side oil chamber OAb to the hydraulic pump 122 is allowed, and hence a flow of hydraulic oil circulating clockwise between the hydraulic pump 122 and the hydraulic cylinder 11 is created, so that a driving force in the expanding direction is generated in the hydraulic cylinder 11.

At this time, considering the case where the hydraulic cylinder 11 is the cylinder as shown in the figure, the amount of hydraulic oil flowing out of the rod-side oil chamber OAb is smaller due to the rod of a piston by the amount of movement of the piston of the hydraulic cylinder as compared with the amount of hydraulic oil flowing into the bottom-side oil chamber OAa. However, due to the bottom-side hydraulic oil having a higher oil pressure, the switching valve 124*b* is switched over so that the pipe line to the rod-side oil chamber OAb and the oil tank 123 are connected to each other, by which hydraulic oil sufficient to make up the shortfall is supplied from the oil tank 123.

On the other hand, when the hydraulic pump 122 is operated so that hydraulic oil is discharged to the rod-side port, a circulating flow of hydraulic oil reverse to the above-described flow is created, and hence a driving force in the contracting direction is generated in the hydraulic cylinder 11. There is therefore an excess of hydraulic oil flowing from the bottom-side oil chamber OAa to the hydraulic pump 122. Since the pipe line to the bottom-side oil chamber OAa and the oil tank 123 are connected to each other, the excess hydraulic oil is returned to the oil tank 123.

The amount of hydraulic oil in the enclosed oil tank 123 is increased or decreased by the position of the piston in the hydraulic cylinder 11, and the pressure of the gas sealed in the oil tank 123 thus also fluctuates. However, by making the volume of sealed gas proper, the operation of the hydraulic drive unit 3 is not affected by the fluctuations in gas pressure.

Thus, the function of the hydraulic drive unit 3 is achieved and maintained though the hydraulic cylinder 11 which is a closed system and in which a difference in amount of hydraulic oil that goes in and out is produced by the operation thereof.

The valves 124 of the hydraulic drive unit 3 are provided with additional components that are described below other than the already described basic components.

In each of the pipe lines between the bottom-side oil chamber OAa of the hydraulic cylinder 11 and the check valve OCa of the operate check valve 124*a* and between the rod-side oil chamber OAb of the hydraulic cylinder 11 and the check valve OCa of the operate check valve 124*a*, a slow return valve 124*e* for throttling only the flow of hydraulic oil from the oil chambers OAa and OAb to the check valves OCa is provided.

These slow return valves 124*e* prevent hunting that might otherwise be generated in the case where an external force is exerted from a driven body W during operation of the hydraulic pump 122.

From the pipe line between the slow return valve 124*e* and the check valve OCa, a pipe line provided with a relief valve 124*c* branches to the oil tank 123. Similarly, from the pipe line between the hydraulic pump 122 and the check valve OCa on the bottom side and the rod side, a pipe line provided with a relief valve 124*d* branches to the oil tank 123.

These relief valves 124*c* and 124*d* let the excess hydraulic oil escape to the oil tank 123 when an abnormal pressure is produced in the main pipe line.

Further, from the pipe line between the slow return valve 124*e* on the rod side and the bottom side and the check valve OCa, a pipe line provided with an emergency manual valve MV branches to the oil tank 123. For example, when the hydraulic pump 122 is stopped by the absence of electric power, the pipe lines of the bottom-side oil chamber OAa and the rod-side oil chamber OAb are released to the oil tank 123 so that the hydraulic cylinder 11 can be operated manually.

According to the above-described configuration, the hydraulic drive unit 3 ensures safety, reliability, and the ability to avoid accidents to prevent damage to the unit 3 while properly achieving the basic function thereof even in the case where an emergency arises.

Based on the above-described points, Example 3 is explained with reference to FIGS. 5(*a*)-(*c*). These figures present schematic views of the hydraulic drive unit 3 of Example 3, in which in contrast to units in the above-described Examples 1 and 2, the position of the hydraulic pump 122 and the configuration of the valves 124 have different structural features. More specifically, in Example 3, the hydraulic pump 122 is provided on the side of the assembly on which the electric motor 121 is disposed in the housing 125.

FIGS. 5(*a*)-(*c*) schematically show the hydraulic drive unit of Example 3, focusing particularly on the assembly's arrangement of parts. FIG. 5(*a*) presents a general arrangement view of Example 3, FIG. 5(*b*) is an arrangement view showing an internal configuration excluding a hydraulic cylinder portion shown in FIG. 5(*a*), viewed from the side, and FIG. 5(*c*) shows an arrangement view expressed in terms of a hydraulic circuit, viewing FIG. 5(*b*) from the top.

The valves 124 include the operate check valve 124*a* for controlling the flow of hydraulic oil in the normal and reverse directions between the hydraulic pump 122 and the hydraulic cylinder 11, the switching valve 124*b* for controlling the flow of hydraulic oil in the normal and reverse directions between the hydraulic pump 122 and the oil tank 123, two types of relief valves 124*c* and 124*d*, and the slow return valve 124*e*. The emergency manual valve MV shown in the hydraulic circuit diagram of FIG. 6 is not shown in FIGS. 5(*a*)-(*c*), but this emergency manual valve MV can provided as necessary.

This hydraulic drive unit 3 features an arrangement of parts constituting the unit 3. Specifically, the electric motor 121 is provided on one side of the housing 125, the oil tank 123 is provided on the side opposite that of the electric motor 121, and the hydraulic cylinder 11 is provided on the side (this direction is referred to as "transverse direction") perpendicular to the installation direction (this direction is referred to as "longitudinal direction") of the electric motor 121 and the oil tank 123. In particular, as shown in FIG. 5(*a*)-(*c*), the hydraulic drive unit 3 is characterized in that in the housing 125, the hydraulic pump 122 is provided on the electric motor 121 side, and the above-described valves 124*a*, 124*b*, 124*c*, 124*d*, and 124*e* are provided in a portion other than the location at which the hydraulic pump 122 is installed.

Even in the above-described arrangement, the function of the whole of the pipe line is kept; the hydraulic unit 3 can independently supply a driving force created by oil pressure to the driven body though being a closed system, and also safety, reliability, and accident avoidance are ensured.

In addition, as shown in FIG. 5(*b*), in this hydraulic drive unit 3, the output shaft of the motor (pump driving shaft) 121*a* is shorter. As a result, the vibrations and driving sound of the shaft 121*a* are reduced, and the degree of shaft fatigue caused by shaft runout is low. Therefore, the reduction in vibrations and driving sound and the prolongation of life of the shaft 121*a* can be achieved, and problems of vibrations, driving sound, and life of the electric motor 121 and the hydraulic pump 122 can be solved.

The arrangement of valves such as the operate check valve 124*a* and the switching valve 124*b* shown in FIG. 5(*b*) is one possible arrangement. The arrangement of these valves 124*a*, 124*b*, etc., is not limited to series arrangement, etc., in this example, except for the condition that the hydraulic pump 122 is provided on the electric motor 121 side.

Also, in this hydraulic drive unit 1, the hydraulic cylinder 11 is provided on the housing 125 so that the longitudinal direction, which is the installation direction of the electric motor 121 and the oil tank 123, is parallel or in a row with respect to the axial direction of the hydraulic cylinder 11.

If the hydraulic cylinder 11 is arranged in this manner, the area the unit 3 occupies in the plane of FIG. 5(*a*) can be decreased as compared with the case where the hydraulic cylinder 11 is arranged in the transverse direction perpendicular to the longitudinal direction, so that this hydraulic drive unit is suitable for installation and assembly at a place where the available installation space is restricted and compactness is required.

Also, hydraulic drive units are severely constrained, in that problems of durability and vibration must be solved while keeping the units' parts contained in as compact a manner as possible in the limited space of a closed system. These embodiments attempt to solve the problems of durability and vibrations under such severe constraints.

The problem that arises because the hydraulic pump 122 is now distant from the oil tank 123 because it has been brought close to the electric motor 121 can be solved by expanding the pipe line between the hydraulic pump 122 and the oil tank 123. On the other hand, according to this example, for the pipes between the various valves 124*a*, 124*b*, etc., an effect that the length of pipe is shortened is achieved.

Further, as shown in FIG. 5(*a*), the hydraulic cylinder 11 is also arranged in the parallel longitudinal direction with respect to the longitudinal direction, which is the installation direction of the electric motor 121 and the oil tank 123 with respect to the housing 125, and the hydraulic cylinder 11 is provided on the housing 125 near the center of the axial length of the hydraulic cylinder 11.

That is to say, both end portions in the lengthwise direction of the hydraulic cylinder 11 are provided so as extend to both of the electric motor 121 side and the oil tank 123 side in the longitudinal direction with respect to the electric motor 121 and the oil tank 123 provided on the housing 125, and are arranged so as not to project in the longitudinal direction of the whole of the unit 3 any farther than is necessary.

In contrast, for example, if the hydraulic cylinder 11 is provided on the housing 125 so as to extend to the oil tank 123 side on the bottom side of the hydraulic cylinder 11, a projection corresponding to the electric motor 121 is produced on the electric motor 121 side with respect to the longitudinal direction of the housing 125, and on the oil the oil tank 123 side, a projection corresponding to the total length of the hydraulic cylinder 11 is produced. Therefore, although the hydraulic drive unit is formed bythe same parts, the layout dimension increases, which is contrary to compactness.

That is to say, as shown in FIG. 5(*a*), the installation of the hydraulic cylinder 11 on the housing 125 near the center of the axial length of the hydraulic cylinder 11 contributes greatly to the compactness of the unit 3.

EXAMPLE 4

Next, still another example (Example 4) is explained with reference to FIGS. 7(*a*)-(*c*). In Example 4, the configuration of the hydraulic pump 122 and the valves 124 disposed in the housing 125 is changed. More specifically, in Example 4, the hydraulic pump 122 is disposed in an intermediate portion of the housing 125.

FIGS. 7(*a*)-(*c*) schematically show a hydraulic drive unit 4 of Example 4, focusing especially on the arrangement of parts in the assembly. FIG. 7(*a*) is a general arrangement view of Example 4, FIG. 7(*b*) is an arrangement view showing an internal configuration excluding a hydraulic cylinder portion shown in FIG. 7(*a*), viewed from the side, and FIG. 7(*c*) is an arrangement view expressed in terms of a hydraulic circuit, viewing FIG. 7(*b*) from the top.

The hydraulic drive unit 4 has a construction in which the electric motor 121 is provided on one side of the housing 125, which is a structure that contains the above-described various valves 124*a*, 124*b*, etc., and the hydraulic pump 122, in which the oil tank 123 is provided on the side opposite that of the electric motor 121, and in which the hydraulic cylinder 11 that serves as a hydraulic actuator is provided on the side (this direction is referred to as the "transverse direction") perpendicular to the installation direction (this direction is referred to as the "longitudinal direction") of the electric motor 121 and the oil tank 123.

Figure 6:
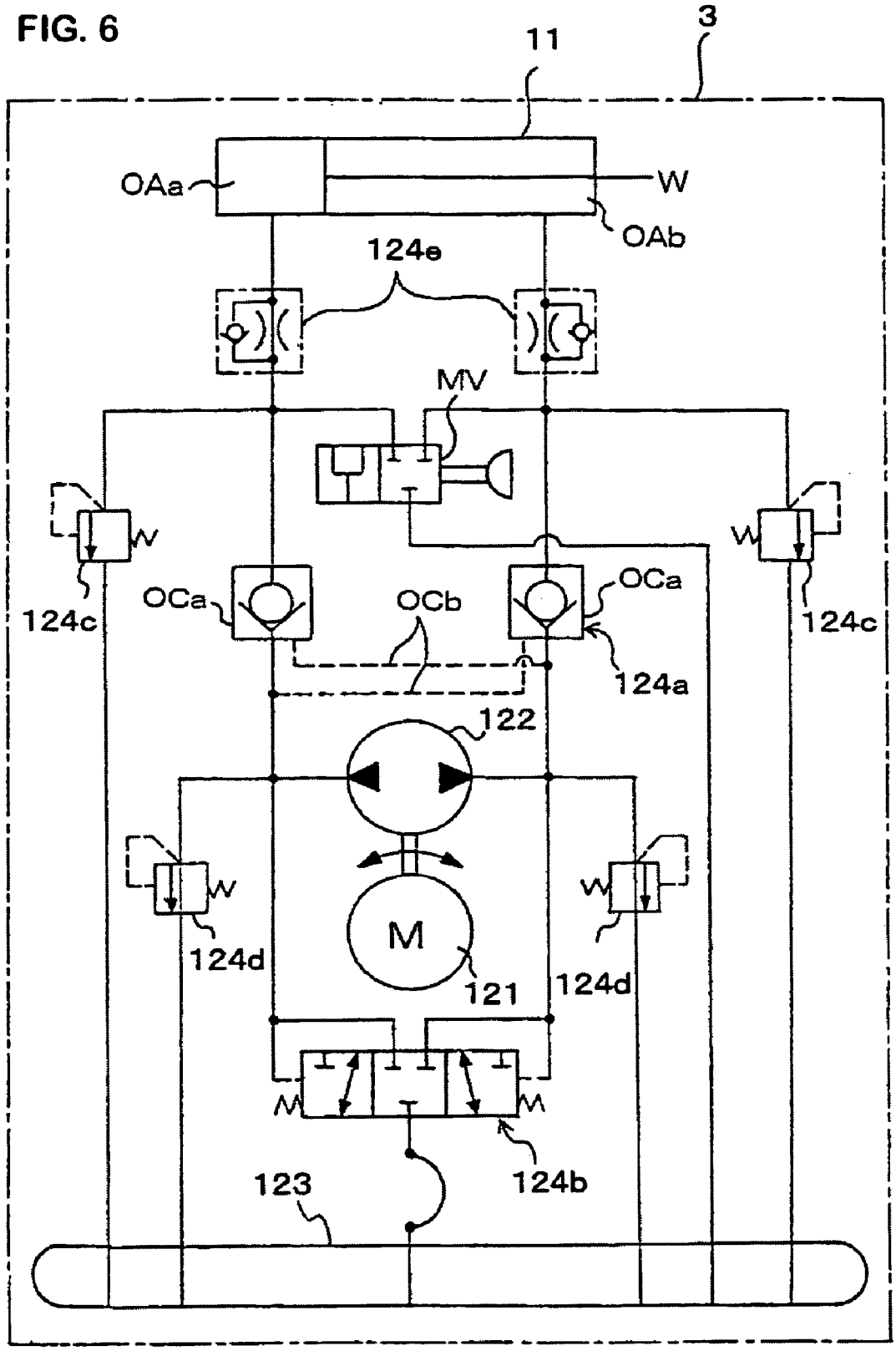
FIG. 6 is a hydraulic circuit diagram showing a basic configuration of a hydraulic drive unit used in the device illustrated in FIGS. 5(*a*)-5(*c*)

As shown in FIGS. 7(*b*) and 7(*c*), in the housing 125, the pump 122 is contained at a position as close as possible to the oil tank 123 in the longitudinal direction with only the switching valve 124*b* directly interposed between the pump and the oil tank 123, with the relief valve 124*d* for the pipe line relating to the switching valve 124*b* in the hydraulic circuit shown in FIG. 6 being provided between the pump and the oil tank 123. As a result, other valves such as the operate check valve 124*a* and the slow return valve 124*e* for the pipe line to the hydraulic cylinder 11 are provided instead on the electric motor 121 side of the hydraulic pump 122 in the longitudinal direction.

In FIG. 7(*c*), reference number 11 indicates that the hydraulic cylinder lies at a position out of the plane of this figure, and that the pipe line to the hydraulic cylinder is present here. Also, the reason why the relief valve 124*c* for the pipe line between the operate check valve 124*a* and the hydraulic cylinder 11 is provided on the oil tank 123 side in the longitudinal direction as compared with the hydraulic pump 122 is that a transverse space is present at this position.

The provision of the hydraulic pump 122 at such a position is based on common technical knowledge of hydraulic pipe lines, i.e., that the length of a pipe line between the hydraulic pump 122 and the oil tank 123 for storing hydraulic oil to be suctioned by the hydraulic pump 122 should be made as short as possible to improve suction. Also, by doing this the configuration of pipe lines can be made more simple.

In order to provide the hydraulic pump 122 in the intermediate portion in the longitudinal direction of the housing 125, it is necessary to divide the housing 125 by a cut plane 125*g* as shown in FIG. 7(*b*) and to make a laminated structure that forms a portion for containing the hydraulic pump 122. Such a laminated structure itself is a technique generally used when a plurality of valves etc. are contained in a single block.

The examples described above may include various features, some of which are described below.

A hydraulic drive unit includes a hydraulic pump for sending hydraulic oil under pressure in normal and reverse directions; an electric motor for driving the hydraulic pump; an oil tank for storing the hydraulic oil; a hydraulic actuator operated by the hydraulic oil; and various valves for controlling the flow of hydraulic oil in the normal and reverse directions among the hydraulic pump, oil tank, and hydraulic actuator to independently give a driving force to a driven body by means of the operation of the hydraulic actuator, characterized in that:

the hydraulic drive unit further includes a housing in which the electric motor is provided on one side thereof, the oil tank is provided on the side of the housing opposite that of the electric motor, and the actuator is provided on a side perpendicular to the installation direction of the electric motor and the oil tank; and the hydraulic pump is provided on the electric motor side of the housing, and the various valves are provided in a portion other than the installation location of the hydraulic pump.

Another hydraulic drive unit is characterized in that the actuator is a hydraulic cylinder, and is provided on the housing so that the cylinder axis thereof is parallel to the arrangement direction of the electric motor, the housing, and the oil tank.

Another hydraulic drive unit is characterized in that the hydraulic cylinder is arranged in parallel, and the electric motor, the housing, and the oil tank are arranged as a whole so as not to project in the parallel direction.

The discussion above provides as examples several devices that embody the present invention. These examples can be modified and changed variously without departing from the teachings of the present invention, and such modifications and changes are embraced in the technical scope of the present invention.

Also, the hydraulic controller and the hydraulic drive unit in accordance with the present invention can be used in all industrial fields in which a driving force created by oil pressure is given to a driven body independently, and a long service life, compactness, and a low cost are desired.

What is claimed is:

1. A hydraulic controller for a hydraulic drive unit, comprising:

a housing that includes an electric motor housing configured to house an electric motor, a hydraulic pump housing configured to house a hydraulic pump, and a valve housing configured to house valves;

the hydraulic pump;

an operate check valve operable to control the flow of hydraulic oil in normal and reverse directions between the hydraulic pump and a hydraulic drive unit actuator; and a switching valve operable to control the flow of hydraulic oil in normal and reverse directions between the hydraulic pump and an oil tank;

wherein an oil tank cover attachment portion that is configured for detachably installing an oil tank cover body is formed at a location on the housing that is opposite an electric motor arrangement surface portion that is configured to receive the electric motor; and wherein in the housing, the operate check valve, the hydraulic pump, and the switching valve are provided in that order from the side of the electric motor arrangement surface portion to the side of the oil tank cover body attachment portion.

2. The hydraulic controller according to claim 1, and further comprising a connecting portion configured for connection to the hydraulic drive unit actuator, wherein the connecting portion is located at a periphery of the housing.

3. The hydraulic controller according to claim 2, wherein the hydraulic controller and the hydraulic drive unit actuator are arranged in parallel to each other when the actuator is connected to the connecting portion.

4. The hydraulic controller according to claim 3, wherein the hydraulic controller and the hydraulic drive unit actuator are configured so that the ends of the hydraulic controller and the hydraulic drive unit actuator do not extend significantly beyond one another in the parallel direction when the hydraulic drive unit actuator is connected to the connecting portion.

5. A hydraulic drive unit comprising the hydraulic controller of claim 1, and the hydraulic drive unit actuator.

6. A hydraulic controller for a hydraulic drive unit, comprising:

a housing that includes an electric motor housing configured to house an electric motor, a hydraulic pump housing configured to house a hydraulic pump, and a valve housing configured to house valves;

the hydraulic pump;

an operate check valve operable to control the flow of hydraulic oil in normal and reverse directions between the hydraulic pump and a hydraulic drive unit actuator; and a switching valve operable to control the flow of hydraulic oil in normal and reverse directions between the hydraulic pump and an oil tank;

wherein an oil tank cover attachment portion that is configured for detachably installing an oil tank cover body is formed at a location on the housing that is opposite an electric motor arrangement surface portion that is configured to receive the electric motor; and wherein in the housing, the hydraulic pump, the operate check valve, and the switching valve are provided in that order from the side of the electric motor arrangement surface portion to the side of the oil tank cover body attachment portion.

7. The hydraulic controller according to claim 6, and further comprising a connecting portion configured for connection to the hydraulic drive unit actuator, wherein the connecting portion is located at a periphery of the housing.

8. The hydraulic controller according to claim 7, wherein the hydraulic controller and the hydraulic drive unit actuator are arranged in parallel to each other when the hydraulic drive unit actuator is connected to the connecting portion.

9. The hydraulic controller according to claim 8, wherein the hydraulic controller and the hydraulic drive unit actuator are configured so that the ends of the hydraulic controller and the hydraulic drive unit actuator do not extend significantly beyond one another in the parallel direction when the hydraulic drive unit actuator is connected to the connecting portion.

10. A hydraulic drive unit comprising the hydraulic controller of claim 6, and the hydraulic drive unit actuator.

11. A hydraulic controller for a hydraulic drive unit, comprising:

a housing that includes an electric motor housing configured to house an electric motor, a hydraulic pump housing configured to house a hydraulic pump, and a valve housing configured to house valves;

the electric motor; and the hydraulic pump;

wherein an output shaft of the electric motor extends at least partway through the housing and is directly connected to a drive gear of the hydraulic pump;

wherein the output shaft of the electric motor is supported by at least one bearing at a single bearing support location along the length of the shaft, and wherein said bearing support location is between the electric motor and the pump.

12. The hydraulic controller according to claim 11, and further comprising a connecting portion configured for connection to a hydraulic drive unit actuator, wherein the connecting portion is located at a periphery of the housing.

13. The hydraulic controller according to claim 12, wherein the hydraulic controller and the hydraulic drive unit actuator are arranged in parallel to each other when the hydraulic drive unit actuator is connected to the connecting portion.

14. The hydraulic controller according to claim 13, wherein the hydraulic controller and the hydraulic drive unit actuator are configured so that the ends of the hydraulic controller and the hydraulic drive unit actuator do not extend significantly beyond one another in the parallel direction when the hydraulic drive unit actuator is connected to the connecting portion.

15. A hydraulic drive unit comprising the hydraulic controller of claim 11, and a hydraulic drive unit actuator driven by hydraulic oil pumped by the hydraulic pump.

* * * * *